United States Patent [19]

Trimborn

[11] Patent Number: 5,073,089

[45] Date of Patent: Dec. 17, 1991

[54] LIQUID-RING COMPRESSOR

[75] Inventor: Peter Trimborn, Nuremberg, Fed. Rep. of Germany

[73] Assignee: Siemens Aktiengesellschaft, Berlin & Munich, Fed. Rep. of Germany

[21] Appl. No.: 527,012

[22] Filed: May 22, 1990

[30] Foreign Application Priority Data

Jun. 5, 1989 [EP] European Pat. Off. ..... 89110169

[51] Int. Cl.[5] ..... F04C 19/00

[52] U.S. Cl. ..... 417/68; 417/69

[58] Field of Search ..... 417/67, 68; 418/266, 418/268

[56] References Cited

U.S. PATENT DOCUMENTS

| | | | |
|---|---|---|---|
| 1,180,613 | 4/1916 | Siemen | 417/68 |
| 4,392,783 | 7/1983 | Jozepaitis | 417/68 |
| 4,521,161 | 6/1985 | Olsen | 417/68 |
| 4,522,560 | 6/1985 | Lubke | 415/210 |
| 4,551,070 | 11/1985 | Olsen et al. | 417/68 |
| 4,850,808 | 7/1989 | Schultze et al. | 417/68 |

FOREIGN PATENT DOCUMENTS 3210161 10/1983 Fed. Rep. of Germany .

*Primary Examiner*—Richard A. Bertsch
*Assistant Examiner*—Michael I. Kocharov
*Attorney, Agent, or Firm*—Kenyon & Kenyon

[57] ABSTRACT

In a liquid-ring rotary compressor having a control element with a suction port, a pressure orifice, and a plurality of supplementary ports in front of the pressure orifice with respect to the direction of rotation of the compressor impeller, each supplementary port having a back-pressure valve, pressure losses are reduced by decreasing the flow area of the supplementary ports toward the pressure orifice so that the total flow area for the supplementary ports that are exposed by the back-pressure valves during the compression operation is roughly proportional, with respect to the prevailing nominal pressure condition of the compressor, to the gas mass existing in the vane chambers. Embodiments for flat and conical control elements is disclosed.

5 Claims, 5 Drawing Sheets

LIQUID-RING COMPRESSOR

BACKGROUND OF THE INVENTION

This invention relates in general to liquid-ring rotary compressors, and more particularly to a control element of such a compressor for reducing pressure losses in the compressor.

A liquid-ring compressor is disclosed in U.S. Pat. No. 4,522,560, the disclosure of which is incorporated herein by reference, and in its German counterpart, DE-C-32 10 161. In the compressor disclosed herein, several supplementary ports configured as slotted holes are provided in front of the pressure orifice.

It has been shown that when the supplementary ports are designed in this manner, particularly at higher suction pressures and in the overpressure range (i.e., at compression pressures higher than atmospheric pressure), considerable pressure losses still occur when the supplementary ports are traversed by flow.

Thus there is a need to achieve a further reduction of pressure losses in liquid-ring compressors of this type.

SUMMARY OF THE INVENTION

In accordance with the present invention, this need is fulfilled by dimensioning the flow area of the individual supplementary ports such that, at each discharge zone location, there is a flow area that is matched to the conditions (gas mass and compression pressure) prevailing at the discharge zone location, thereby producing minimal losses.

In the case of a liquid-ring compressor having a flat control disk, it is particularly advantageous for the supplementary ports to extend in the radial direction up to the liquid ring in such a way that the envelope curve across the radial, external extremities of the supplementary ports corresponds at least approximately to the curve of the liquid ring that arises under the nominal operating pressure condition of the compressor. This also achieves a better tolerance of the liquid conveyance on the suction side. Excess liquid can be discharged already through the supplementary ports reaching up to the liquid ring, in front of the actual pressure orifice, so that instances of compression causing loss of efficiency no longer occur in the area of the apex of the compressor.

The desired dimensioning of the flow area of the supplementary ports is achieved in the case of a liquid-ring compressor with a conical control element by using supplementary ports configured as rectilinear slotted holes whose length decreases toward the pressure orifice.

DETAILED DESCRIPTION

Figure 1:
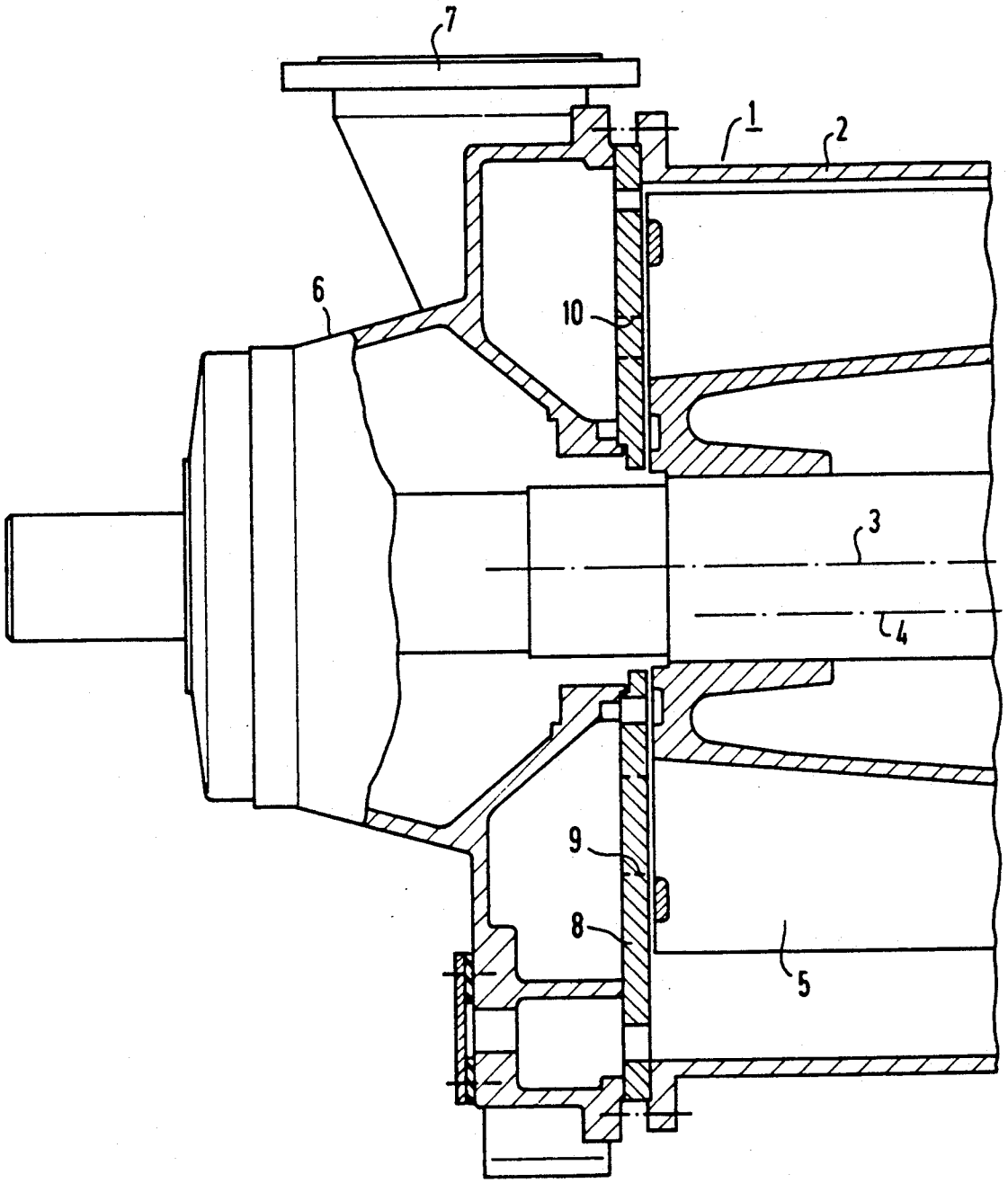
FIG. 1 is an elevation view of a liquid-ring compressor with a flat control disk partially in section.

In the liquid-ring compressor 1 illustrated partially in a sectional view in FIG. 1, the compressor housing 2 encloses an impeller 5 having its shaft axis 3 displaced with respect to the housing axis 4 so as to result in eccentric rotation. The bearing arrangement for the impeller 5 is provided by bearing brackets 6 mounted on the compressor housing 2. A suction connection 7 and a pressure connection (not shown) are mounted respectively on the one bearing bracket 6 depicted in the drawing. Of these connections, only the suction connection 7 is visible in the transverse representation. A flat control disk 8 is disposed between the bearing bracket 6 and the compressor housing 2. The control disk 8 features at least a suction port 9 and a pressure orifice 10. The suction connection and the pressure connection communicate by way of this suction port 9 and pressure orifice 10 with the vane chambers covering the suction port 9 and the pressure orifice 10. Gas can be drawn in this manner via the suction connection 7 and the suction port 9 into the respective vane chambers and can be discharged via the pressure orifice 10 and the pressure connection out of the respective vane chambers.

Figure 2:
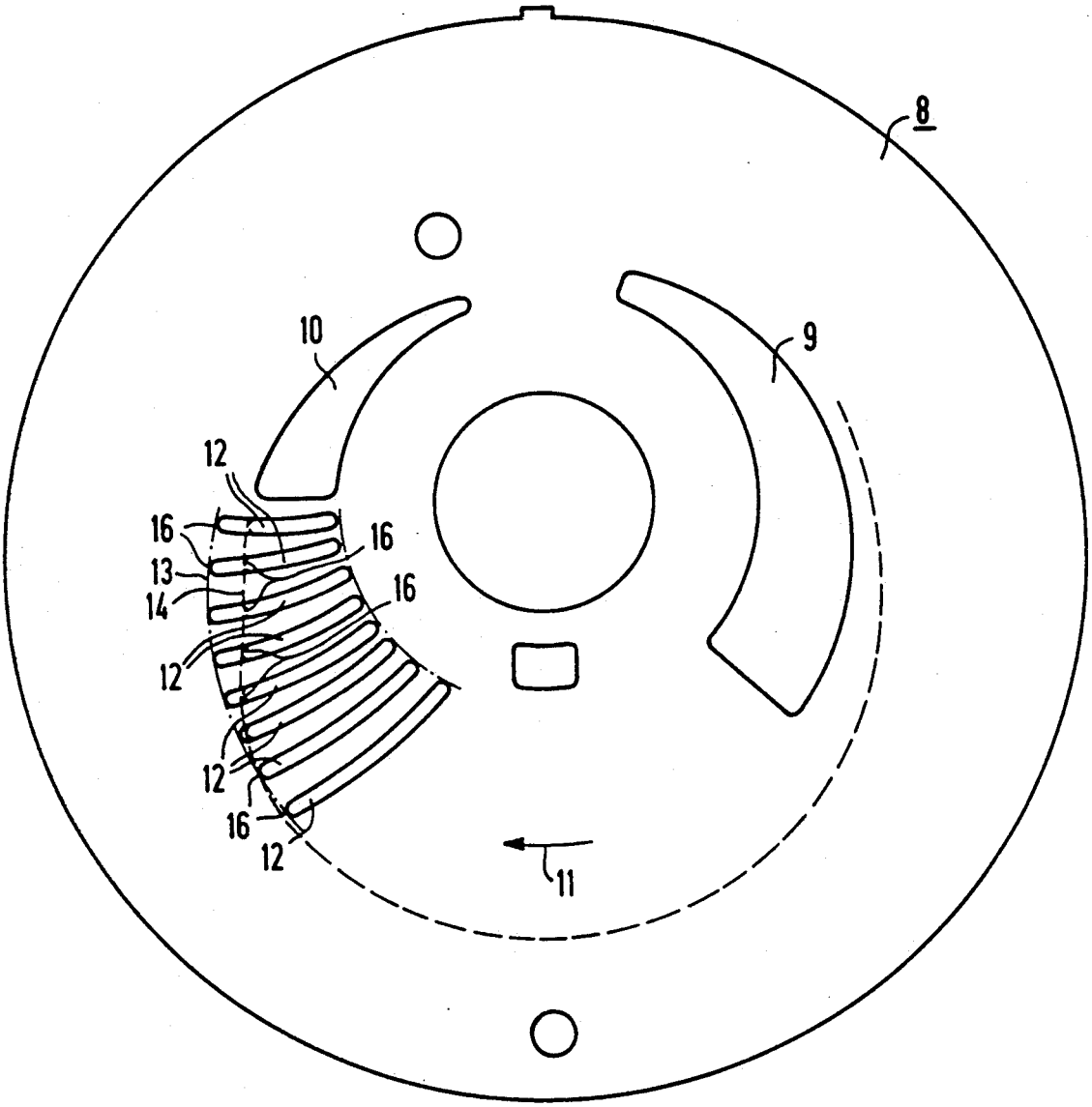
FIG. 2 is a top view of a flat control disk designed for specific nominal pressure conditions.
Figure 3:
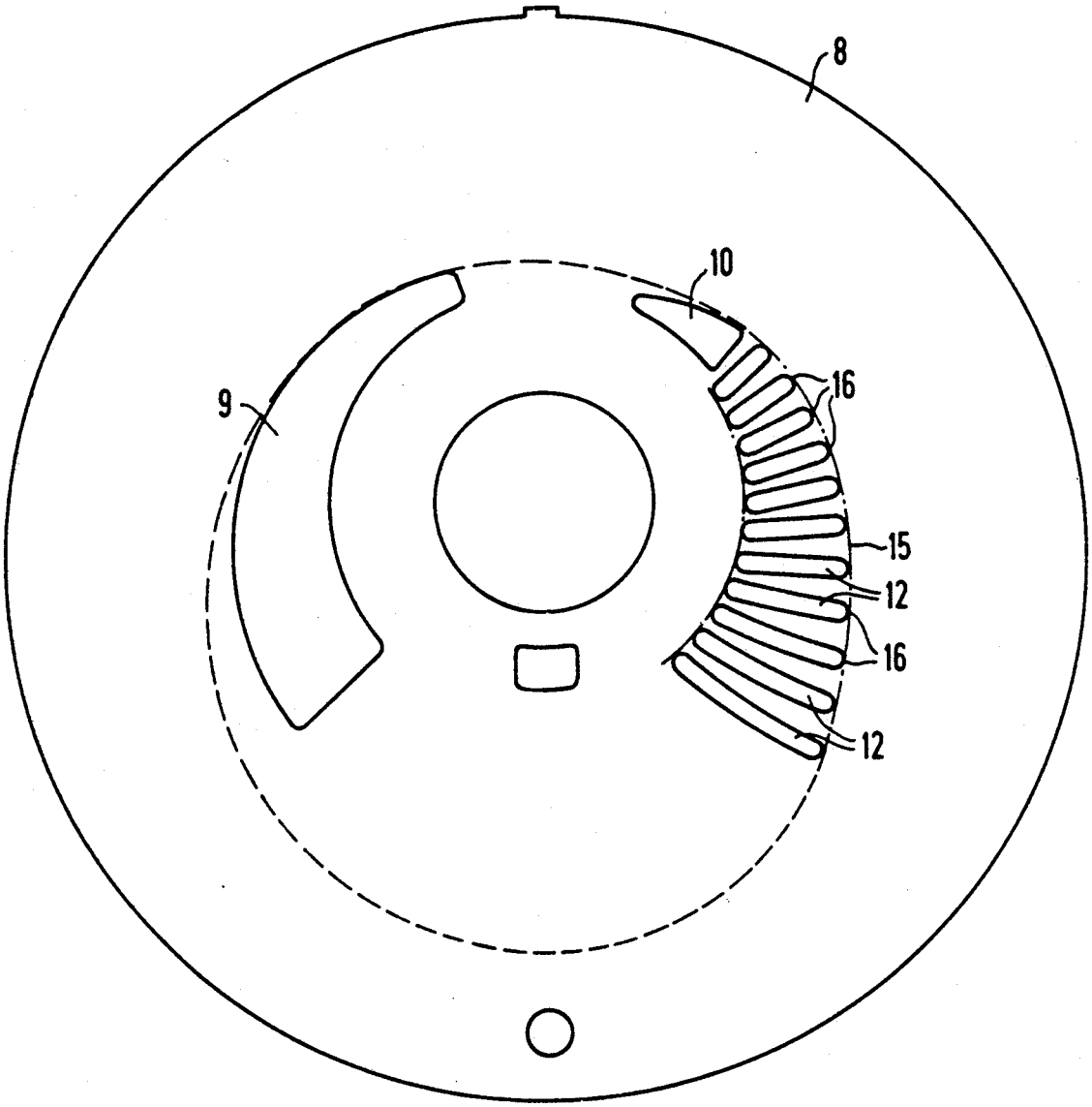
FIG. 3 is a top view of a flat control disk designed for another nominal pressure condition.

As shown in FIGS. 2 and 3, several supplementary ports 12 are provided on the flat control disk 8 in front of the pressure orifice 10 with respect to the direction 11 of rotation. These supplementary ports 12 are covered by back-pressure valves (not shown) on the side of the control disk 8 facing away from the impeller 5. Each back-pressure valve exposes the corresponding supplementary port 12 when the pressure prevailing in the vane chamber passing by the supplementary port is slightly higher than the pressure at the pressure connection. The gas that is compressed in the vane chamber is therefore able to escape.

The supplementary ports 12 are designed with varying radial lengths such that the lengths of the supplementary ports 12 decrease toward the pressure orifice !0. As a result, each successive supplementary port 12 has a smaller flow area than the preceding port. The width of each port is at most slightly narrower than the thickness of the vanes of the impeller 5. The radial profile of the supplementary ports 12 is also matched to the radial profile of the vanes, so that a supplementary port 12 is completely covered when a vane passes by. This avoids return flows through the supplementary ports 12 between two different vane chambers.

In FIGS. 2 and 3 the shapes of the liquid ring in the compressor that result at varying ratios of nominal pressure are indicated by numbers 13, 14 and 15. The shape 13 arises in the case of a liquid-ring compressor with a low nominal pressure ratio, for example 2:1. The shape of the liquid ring 14 is for a compressor with an average nominal pressure ratio of approximately 5:1. The liquid ring takes on a shape 15 in a liquid-ring compressor designed for high pressure ratios of approximately 30:1 to 40:1.

The supplementary ports 12 are dimensioned in their radial length to extend with their external, radial extremity 16 up to the edge 13, 14, or 15 of the liquid ring that arises according to the nominal pressure ratio of the compressor. Maximum flow area for each individual supplementary port 12 is thereby achieved, as well as a maximum total flow area for the supplementary ports 12 that are exposed by the back-pressure valves in accordance with the prevailing pressure conditions. Thus, the available flow area is proportional in a first approximation to the gas mass existing in the vane chambers, thereby reducing pressure losses considerably.

Since the radial extremities 16 of the supplementary ports 12 extend up to the liquid ring which forms an envelope curve for these extremities 16, any excess fluid is expelled through the supplementary ports 12 distal from the pressure orifice. This alleviates accumulation of the liquid at the apex of the compression region and resultant loss of efficiency.

Figure 4:
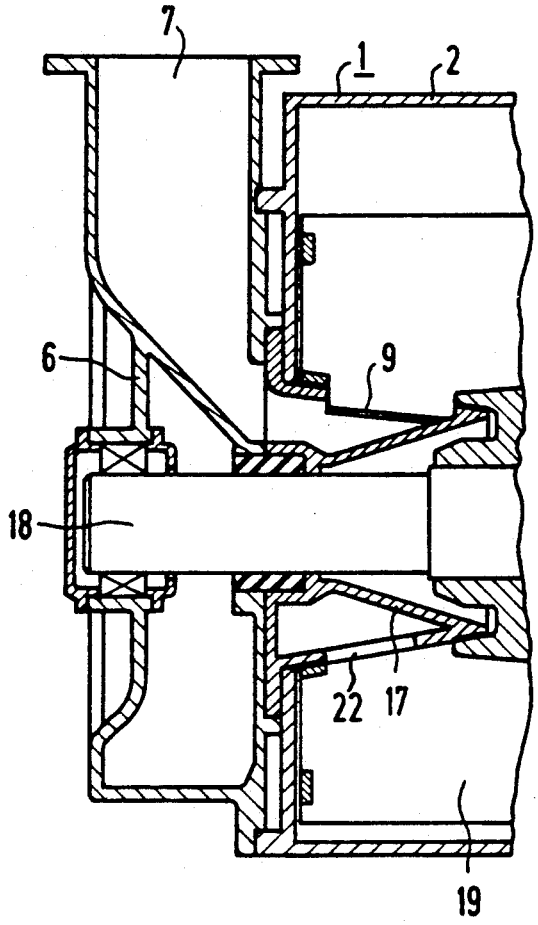
FIG. 4 is an elevation view of a liquid-ring compressor with a conical control element partially in section.
Figure 5:
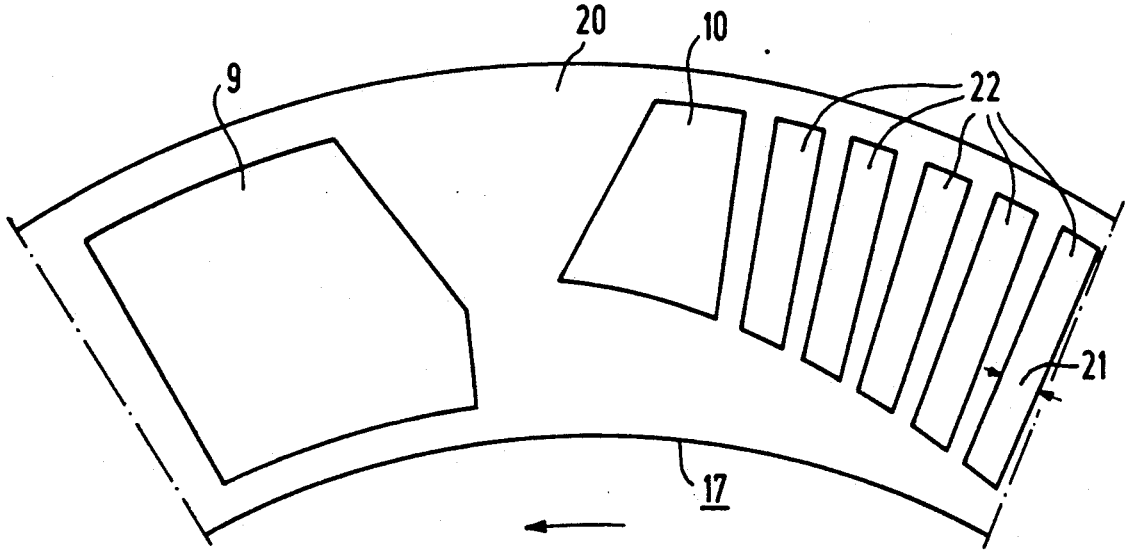
FIG. 5 is a rolled-out representation of a conical control element.

In the liquid-ring compressor 1 shown in FIGS. 4 and 5, a conical control element 17 is provided in place of a flat control disk 8. This control element extends co-axially to the shaft 18 of the compressor and partially under the impeller 19. A suction port 9 and a pressure orifice 10 are provided on the cone surface 20 of control element 17. Several supplementary ports 22 are placed in front of the pressure orifice. The width 21 of these supplementary ports 22 is at most slightly narrower than the thickness of the vanes on the vane base. Through these two measures a supplementary port 22 is completely covered when a vane passes by. Each successive supplementary port 22 is axially shorter than the preceding supplementary port. The flow area of the supplementary ports 22 proximal to the pressure orifice 10 is therefore smaller than the area of the distal ports. The reduction in size from supplementary port to supplementary port is selected to allow the total flow area of the respective supplementary ports 22 exposed by the back-pressure valves to be roughly proportional to the gas mass existing in the respective vane chambers. The degree of reduction in size from supplementary port to supplementary port is determined by the nominal pressure condition of the compressor.

Figure 6:
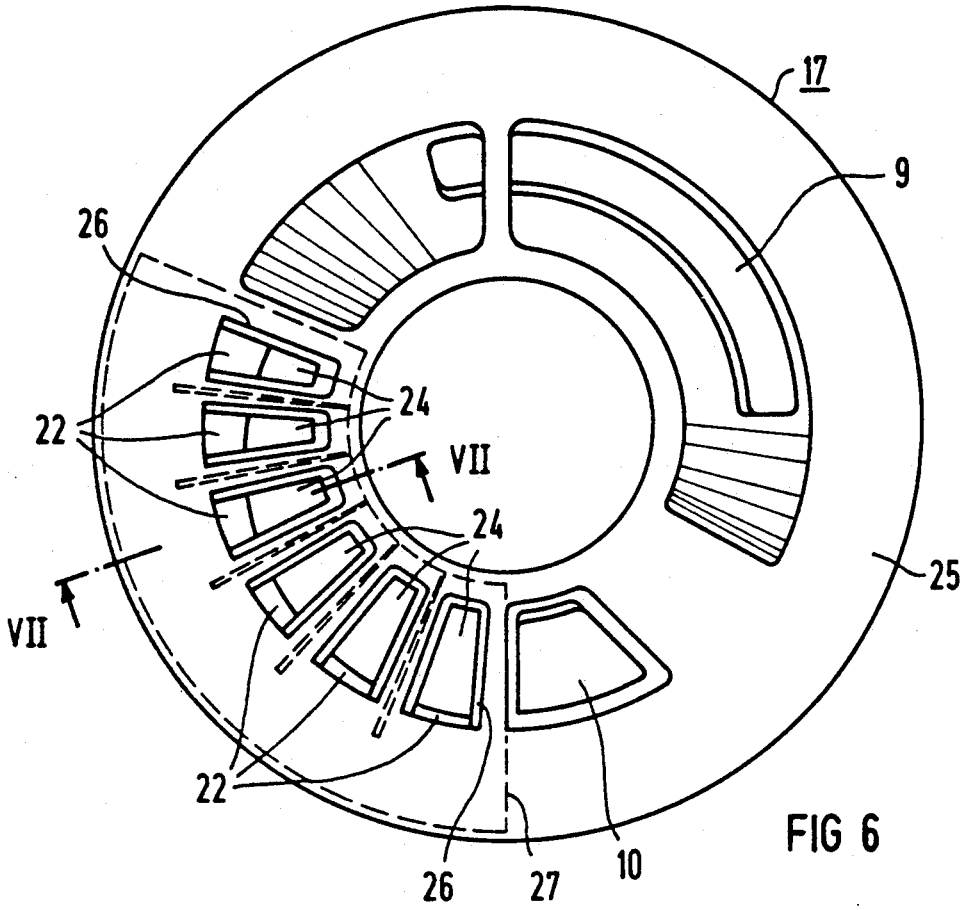
FIG. 6 is a front view of a conical control element.
Figure 7:
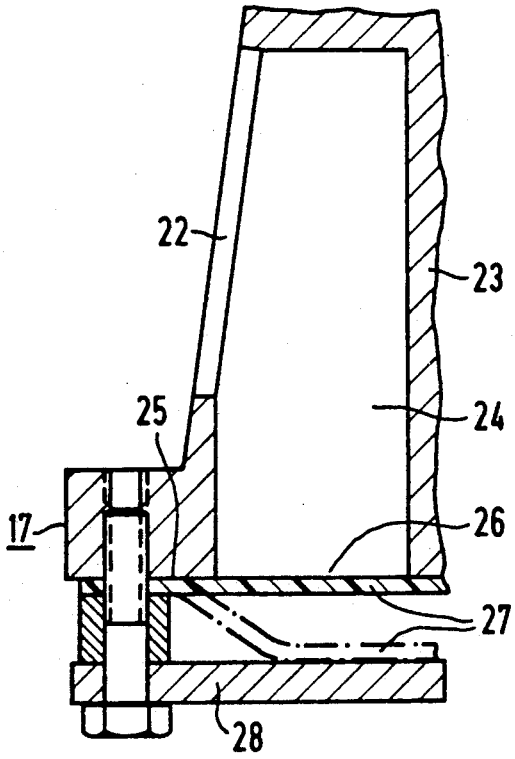
FIG. 7 is a sectional view of the conical control element along the line VII—VII in FIG. 6.

As shown in FIGS. 6 and 7, each supplementary port 22 opens out into a channel 24 formed in member 23 of the conical control element 17. The channels 24 are closed upon themselves except for their outlet orifice 26 situated on the base side 25 of the conical control element 17 and are delimited from each other. A sufficient cross-sectional flow area is available through these channels 24 for the gas mass to be carried away, so that no additional pressure losses occur.

It is also possible to cover the outlet orifices 26 situated on the front side 25 by means of a back-pressure valve. As shown in FIG. 7, this back-pressure valve may consist of a flexible valve plate 27 that lies on the outlet orifice 26. Deflection of the valve plate 27 is limited by an impactor plate 28 arranged at a specific distance from the valve plate 27. The valve plate 27 comes to rest (shown in phantom) on the impactor plate 28, when gas and/or liquid is discharged via the respective supplementary port 22 and the channel 24. In an alternate embodiment, valve tongues extend into the cone to directly cover the supplementary ports. This eliminates the gas-filled chamber between the supplementary ports and the valve tongues shown in the embodiment illustrated in FIG. 7.

The disclosed conical control element 17 provides a continuous, finely graded adaptation to changing compression conditions with a single control element design. Varying pressure conditions do not require different cone designs.

I claim:

1. A liquid-ring compressor comprising:

a. a housing having a central axis;

b. bearing brackets mounted on opposite ends of said housing;

c. an impeller supported by said bearing brackets for rotation within said housing about an axis of rotation offset from the central axis of said housing, said impeller having a multiplicity of radially extending vanes forming a plurality of vane chambers therebetween, such that when the compressor is operating with a liquid ring in place, each vane chamber encloses a mass of gas being compressed, said offset resulting in eccentric rotation in which there is defined within said housing an intake region and a compression region;

d. a suction connection and a pressure connection attached to at least one of said bearing brackets;

e. a control element, mounted between said at least one of said bearing brackets and said impeller, having formed therein a suction port fluidically communicating with the suction connection and the vane chambers of the impeller when the vane chambers are in the intake region, and a pressure orifice, and a plurality of supplementary ports in front of the pressure orifice with respect to the direction of rotation of the impeller, each supplementary port having an associated back-pressure valve, said pressure orifice fluidically communicating through said backpressure valves, with said pressure connection and said vane chambers of the impeller when said vane chambers are in said compression region, each of said supplementary ports having an associated flow area, the flow area of each supplementary port diminishing in size toward said pressure orifice so that the ratio of the flow area for said supplementary ports exposed by said back-pressure valves in the compression region to said gas mass existing in the vane chambers in communication with said supplementary ports is approximately constant for the prevailing nominal pressure condition of the compressor.

2. The liquid-ring compressor of claim 1 wherein:

a. said control element is a flat control disk; and b. the radial, external extremities of said supplementary ports define an envelope curve such that when the compressor is operating with a liquid ring in place at nominal pressure conditions, the envelope curve corresponds at least approximately to the characteristic radially inner boundary of the liquid ring.

3. The fluid-ring compressor of claim 1 further comprising a shaft supported in said bearing brackets for rotation within said housing about an axis of rotation offset from said central axis of said housing and wherein:

a. said impeller is attached to said shaft;

b. said control element is conical, having a radially outer conical surface and a base surface, and surrounding said shaft concentrically by an axial partial length; and c. said supplementary ports are rectilinear slotted holes, having lengths which decreases toward said pressure orifice.

4. The fluid-ring compressor of claim 3 and further comprising a plurality of channels, each channel being in fluidic communication with one of said supplementary ports and having an outlet orifice in said base surface of said conical control element, said outlet orifice being selectively covered by one of said back-pressure valves.

5. The liquid-ring compressor of claim 4 wherein said back-pressure valves are plate valves.

* * * * *